US006149332A

United States Patent [19]

Huang

[11] Patent Number: 6,149,332

[45] Date of Patent: Nov. 21, 2000

[54] AUXILIARY PENCIL EXTENDING CAP

[76] Inventor: Hsien-Tu Huang, NO. 56, Sheng Street, Feng-Yuan City, 42041, Taiwan

[21] Appl. No.: 09/558,004

[22] Filed: Apr. 24, 2000

[51] Int. Cl.[7] ..... A45D 40/20

[52] U.S. Cl. ..... 401/88; 401/92

[58] Field of Search ..... 401/88, 91, 95, 401/6, 92, 117, 98

[56] References Cited

U.S. PATENT DOCUMENTS

| | | | |
|---|---|---|---|
| 126,448 | 5/1872 | Davis | 401/88 |
| 368,517 | 8/1887 | Cornwall | 401/88 |
| 1,704,772 | 3/1929 | Spikins | 401/88 |
| 1,931,138 | 10/1933 | Staff | 401/88 |
| 4,601,598 | 7/1986 | Schwartz et al. | 401/88 |

FOREIGN PATENT DOCUMENTS

| | | | |
|---|---|---|---|
| 2236282 | 4/1991 | United Kingdom | 401/95 |

*Primary Examiner*—Henry J. Recla
*Assistant Examiner*—Huyen Le

[57] ABSTRACT

An auxiliary pencil extending cap mainly comprises a cap and a fastening ring, the cap is hollow and in cylindrical shape, two opposite slits are disposed on one end of the cap and are arranged on the same axis of the length of the cap, two opposite indentations are disposed next to the slits on the cap, a longitudinal hole is found inside the indentations, few protruded bars are disposed on the inner surface of the cap and are arranged on the same axis of the length of the cap, the fastening cap is in circular shape and having an opening, a flat rod is extended downwards from the fastening ring, the diameter of the slits is contracted by moving the fastening ring on the slits of the cap, so that the fastening ring grip on the top of the pencil in order to lengthen the length of the pencil, the indentations are for fingers to put on to move the cap more convenient, and the longitudinal hole is for user to see through if the pencil is inside or the length of the pencil.

2 Claims, 7 Drawing Sheets

AUXILIARY PENCIL EXTENDING CAP

BACKGROUND OF THE INVENTION

The present invention relates to pencil cap and more particularly to a pencil cap that can extend the length of short pencils for convenient writing.

Referring to FIG. 1, when a pencil 10 comes to its end of usage, it becomes very short in length and thus makes it very difficult to hold. Users can hardly write properly and have to dispose it. It is a waste of resource and especially children will develop a wrong value, instead of the virtue of saving.

SUMMARY OF THE PRESENT INVENTION

The present invention relates to an auxiliary pencil extending cap, it mainly comprises a cap that can be capped on a pencil and a fastening ring. The cap is hollow and cylindrical in shape with a preset length. Two slits are disposed on one end of the cap on the same axis facing each other. The cap also has two indentations opposite to each other. A longitudinal hole is disposed on the indentations. The indentations are for fingers to put inside to slide the cap that encloses the pencil. Protruded bars are disposed on the inner surface of the cap and are arranged on the same axis of the length of the cap. The protruded bars are for pressing against the pencil. The fastening ring having an opening that can expand due to its elasticity. A flat rod is extended downwards from the fastening ring. Accordingly, fasten the fastening ring on the cap where the slits are so as to contract the end of the cap to grip on the pencil. As a result, the length of the pencil is extended and makes it easier to hold, and doesn't waste the pencil.

Thus the primary purpose of the present invention is to provide an auxiliary pencil extending cap for convenient gripping by users when pencils get too short in order to save our valuable resource. The secondary purpose is provide a means for gripping a pencil on pocket.

The present invention will become more fully understood from the following detailed description when taken in conjunction with the accompanying drawings.

DETAILED DESCRIPTION OF THE PREFERRED EMBODIMENT

Figure 1:
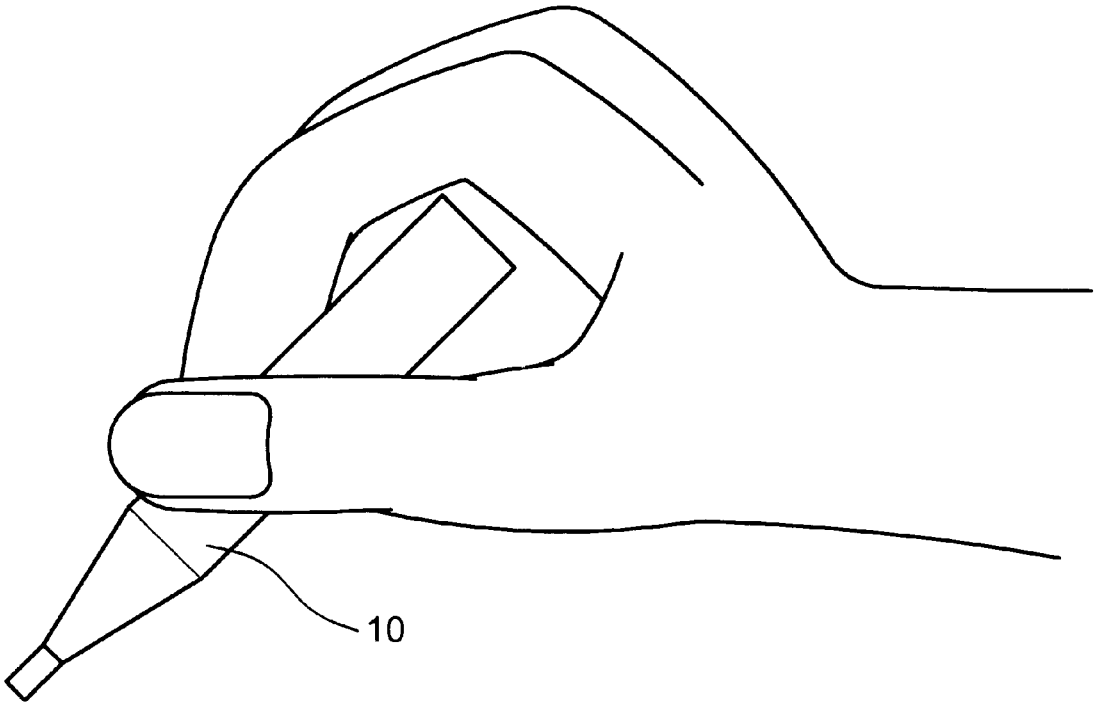
FIG. 1 Prior Art
FIG. 1 is a perspective view of a short pencil to show its inconvenience for user to hold and makes it difficult to write properly.
Figure 2:
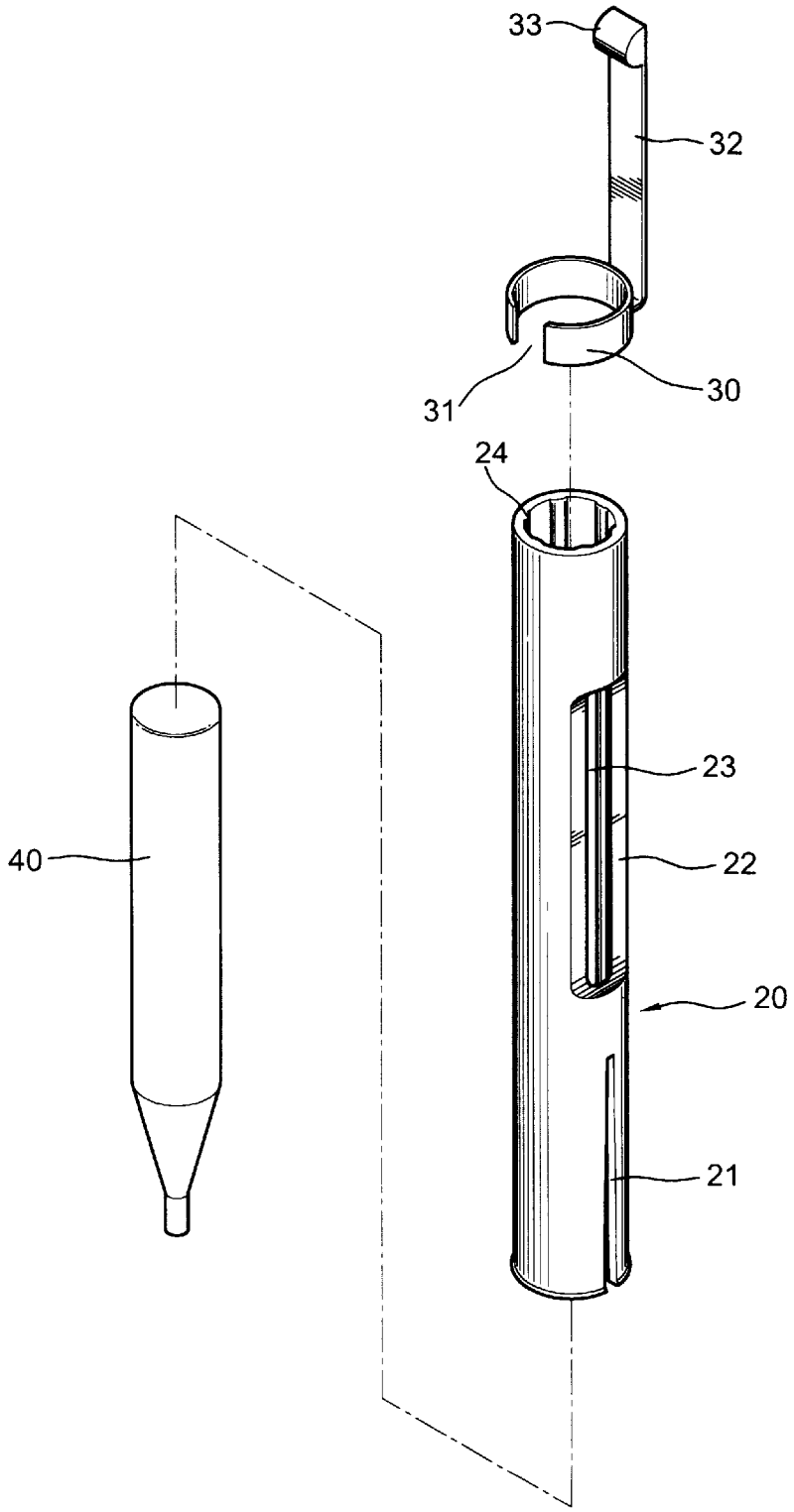
FIG. 2 is an exploded perspective view of an auxiliary pencil extending cap of the present invention.

The present invention of an auxiliary pencil extending cap as shown in FIG. 2, it mainly comprises a cap 20 and a fastening ring 30. The cap 20 can be sleeved on a pencil 40. The cap 20 is hollow and in cylindrical shape, two slits 21 are disposed on its one end facing each other and are on the same axis of the length of the cap 20. The slits 21 will contract in diameter when pressing the cap 20. Two opposite indentations 22 are also disposed on the cap 20, with a longitudinal hole 23 inside the indentations 22. The pencil 40 can be seen through the longitudinal hole 23 of the cap 20. The indentations 22 are for fingers to put inside to move the cap 20. Six protruded bars 24 arranged on the same axis of the length of the cap 20, and are placed on the inner surface of the cap 20. The protruded bars 24 are for pressing against circular, triangular or hexagonal pencil. The fastening ring 30 having an opening 31 and a flat rod 32 extended downwards from the fastening ring 30. A protruded end 33 is disposed at the end of the flat rod 32. The opening 31 provides elasticity for the fastening ring 30 to contract and fasten, and the flat rod 32 can be used for gripping on a pocket.

Figure 3:
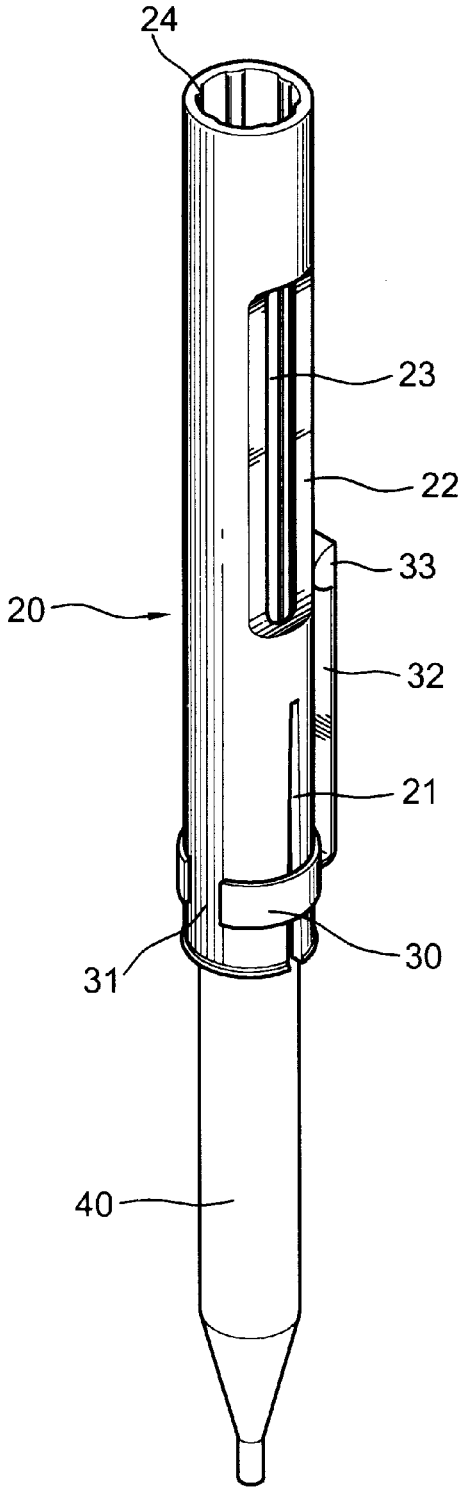
FIG. 3 is a perspective assembly view of an auxiliary pencil extending cap.
Figure 4:
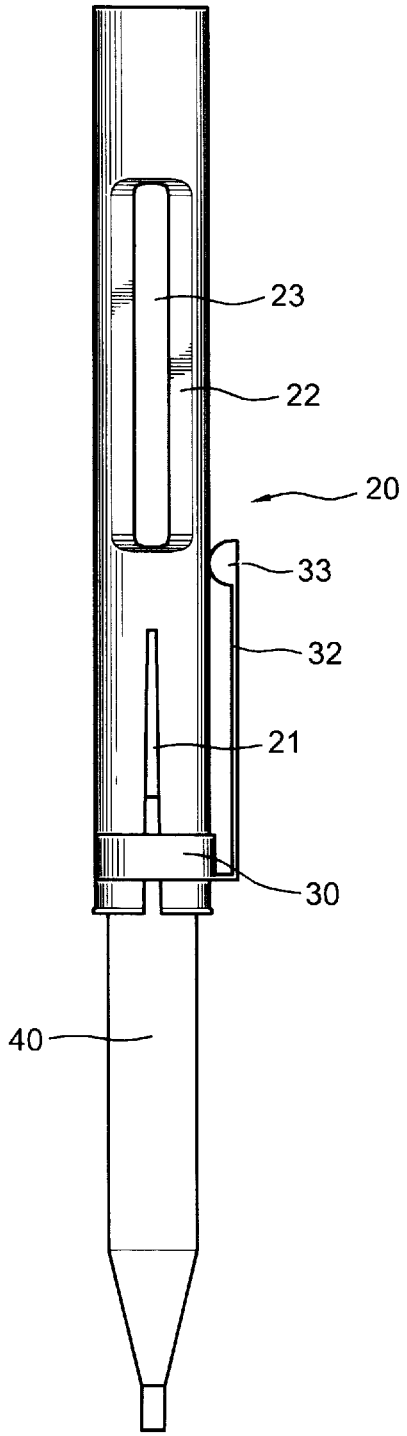
FIG. 4 is a plane assembly view of an auxiliary pencil extending cap.
Figure 5:
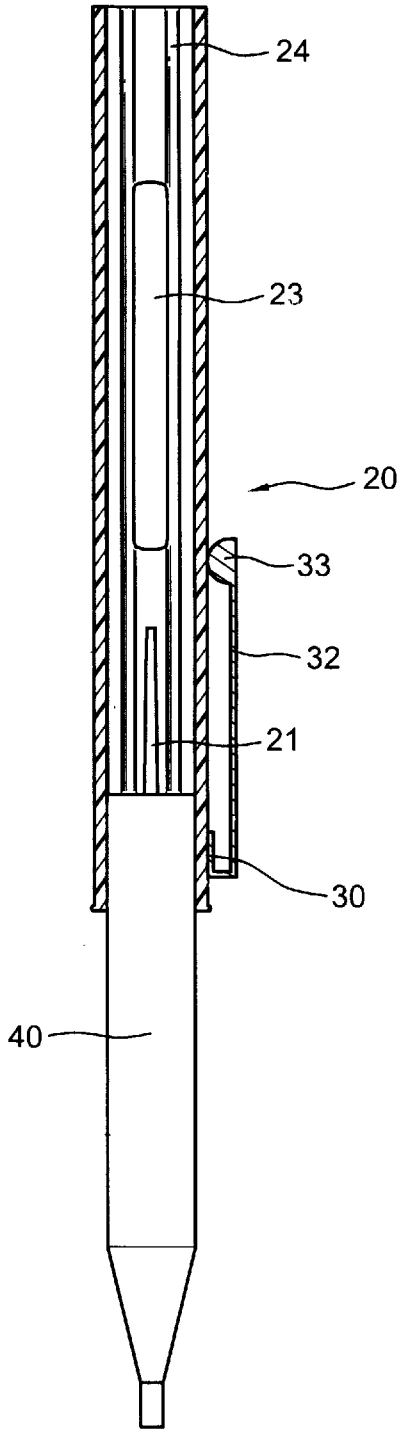
FIG. 5 is a sectional assembly view of an auxiliary pencil extending cap.
Figure 10:
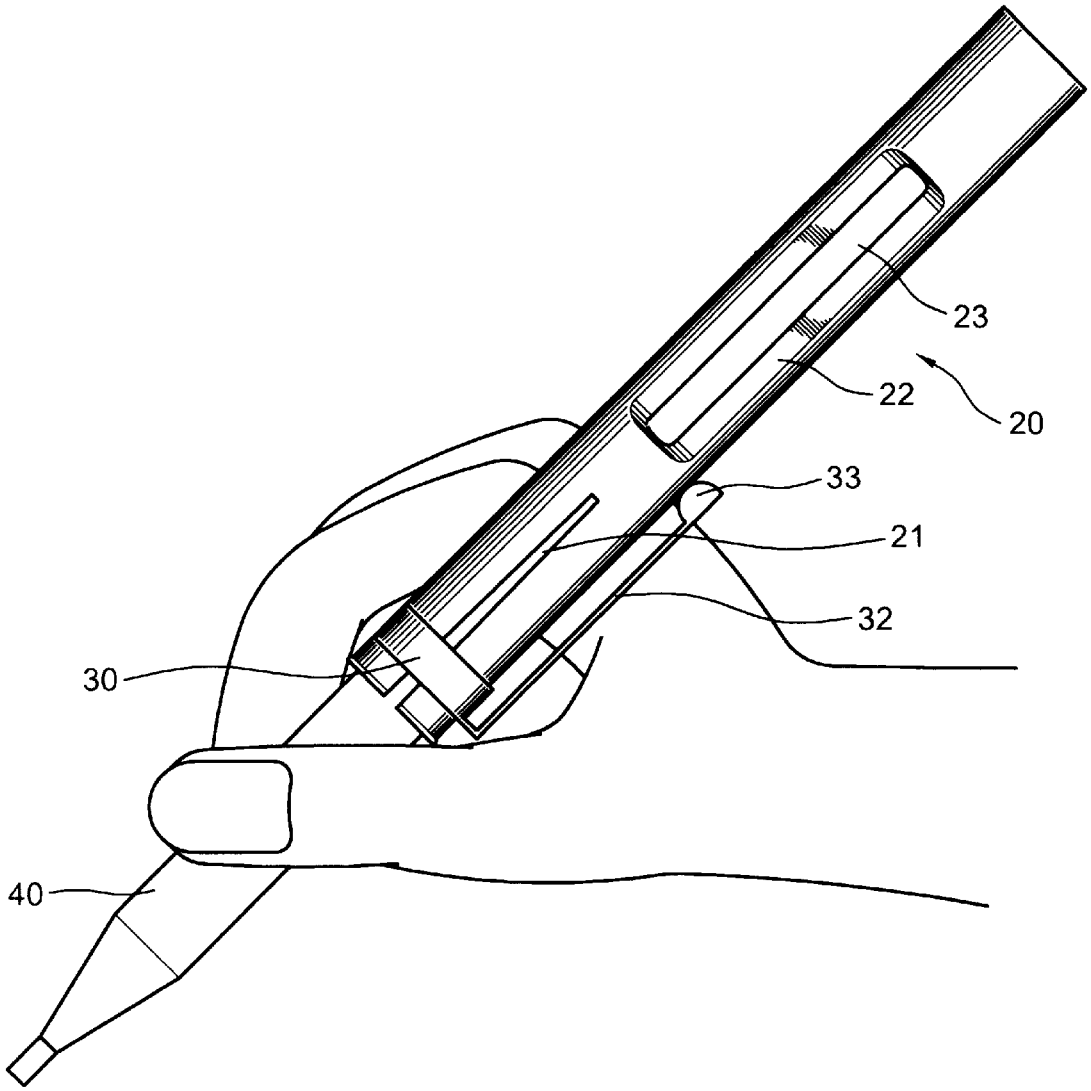
FIG. 10 is a perspective view of a convenient application of an auxiliary pencil extending cap sleeves on a pencil.

Accordingly, as shown in FIGS. 3, 4 and 5, sleeve the cap 20 on the pencil 40 and move the cap 20 upwards with fingers pressing on the indentations 22 until the slits 21 grip on the pencil 40 on its top. Then move the fastening ring 30 downwards to grip on the slits 21 of the cap 20. Therefore, the slits 21 contract and reduce the diameter of the cap 20 to grip on the pencil 40 on its end. Thus the cap 20 is sleeved on the top of the pencil 40 in order to lengthen the length of the pencil 40. As shown in FIG. 10, it is more convenient to hold the pencil 40 because it is extended to a longer length.

Figure 6:
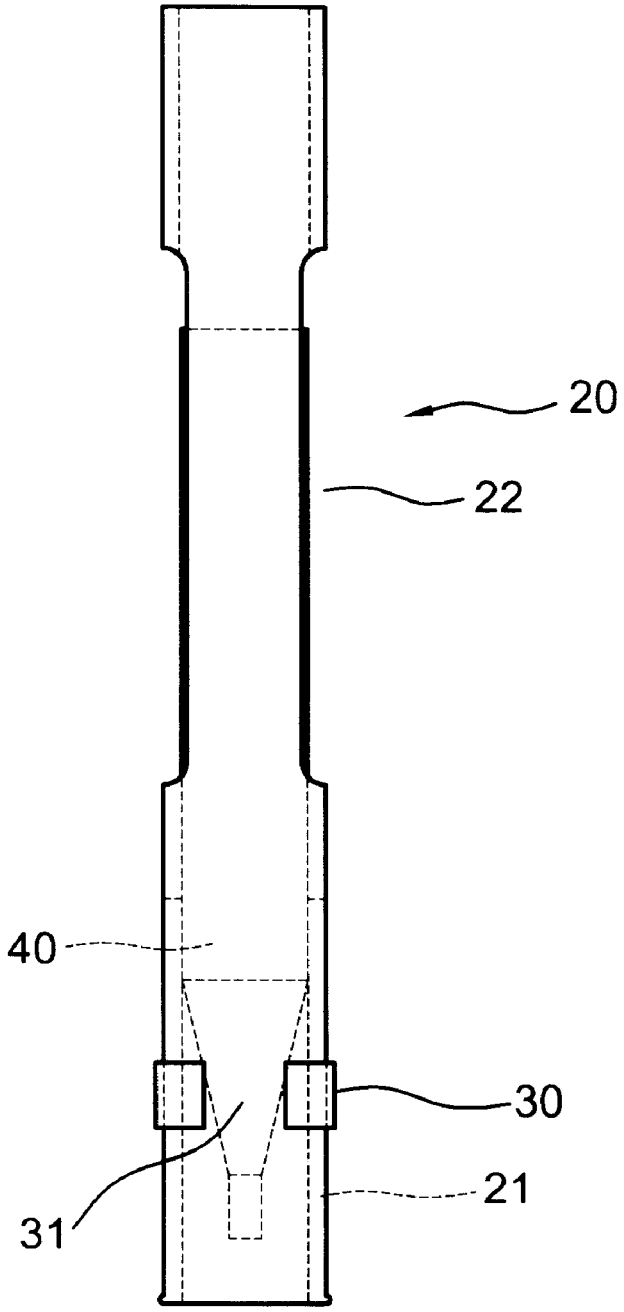
FIG. 6 is a plane view of an auxiliary pencil extending cap sleeves on a pencil lead.

As shown in FIG. 6, besides its main purpose to extend the pencil 40, the cap 20 can also be a cap to cap on the pencil lead of the pencil 40. The indentations 23 are for fingers to put on in order to move the cap 20 more conveniently and user can see through the longitudinal hole 23 to know if the pencil 40 is inside the cap 20.

Figure 7:
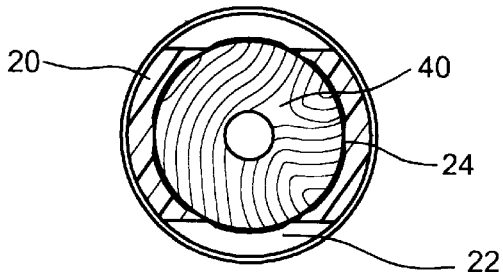
FIG. 7 is a sectional view of an auxiliary pencil extending cap sleeves on a circular pencil.
Figure 8:
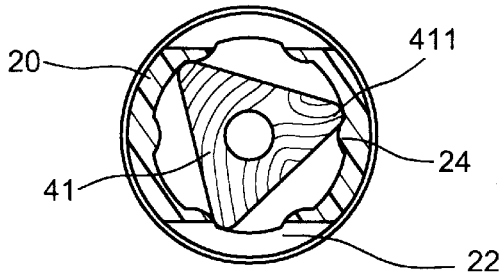
FIG. 8 is a sectional view of an auxiliary pencil extending cap sleeves on a triangular pencil.
Figure 9:
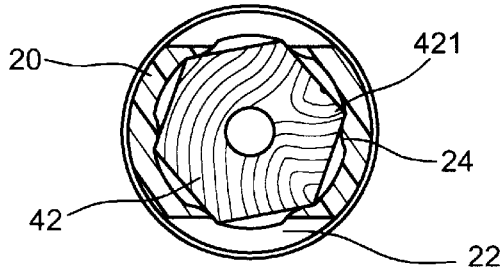
FIG. 9 is a sectional view of an auxiliary pencil extending cap sleeves on a hexagonal pencil.

Referring to FIG. 7, the protruded bars 24 of the cap 20 are for the pencil 40 to press against. If the pencil 40 is in circular shape, the protruded bars 24 press against the circumference of the pencil 40. As shown in FIG. 8, if the pencil 41 is in triangular shape, turn and adjust the pencil 41 so that three of the protruded bars 24 press against the angles 411 of the pencil 41 respectively. Referring to FIG. 9, if the pencil 42 is in hexagonal shape, the protruded bars 24 press against the parts of the lines next to the angles 421.

The flat rod 32 of the fastening ring 30 is similar to a conventional pen gripper for gripping on pocket, which makes it more convenient to carry a short pencil without losing it.

Although the invention has been explained in relation to the preferred embodiment, it is to be understood that many other possible modifications and variations can be made without departing from the spirit and scope of the invention as hereinafter claimed.

I claim:

1. An auxiliary pencil extending cap mainly comprises a cap and a fastening ring for sleeving on a pencil, the cap is hollow and in cylindrical shape with a preset length, two opposite slits are disposed on one end of the cap and are arranged parallel to the axis of the length of the cap, the cap also having two opposite indentations, each having a longitudinal hole such that fingers can be placed on the indentations to move the cap sleeved on the pencil, protruded bars for pressing against the pencil are disposed on the inner surface of the cap and are arranged along the axis of the length of the cap, the fastening ring having an opening which features elasticity to contract or expand, a flat rod extending from the fastening ring, the fastening ring being disposed over the slits of the cap to contract its diameter in order to grip on the pencil the flat rod being disposed to lie against the cap for attaching the auxiliary pencil extending cap to a user, so that the pencil is lengthened by the cap for convenient writing and also can save our resources.

2. An auxiliary pencil extending cap as claimed in claim 1 wherein the cap having six protruded bars to suit and grip on different shapes of pencils.

* * * * *